United States Patent [19]

Andrews, Jr. et al.

[11] 4,193,840

[45] Mar. 18, 1980

[54] LABORATORY MINIDIGESTERS AND METHOD OF USING THE MINIDIGESTERS

[75] Inventors: Russell S. Andrews, Jr., Warwick, N.Y.; Emmett V. Moseley, Mobile, Ala.

[73] Assignee: International Paper Company, New York, N.Y.

[21] Appl. No.: 938,110

[22] Filed: Aug. 30, 1978

[51] Int. Cl.[2] ..... D21C 7/10; D21C 7/12; D21C 7/14

[52] U.S. Cl. ..... 162/49; 162/61; 162/238; 162/241; 162/250; 422/112; 422/307

[58] Field of Search ..... 162/49, 250, 262, 61, 162/241, 233, 238, DIG. 10; 422/112, 307

[56] References Cited

U.S. PATENT DOCUMENTS

| | | | |
|---|---|---|---|
| 336,078 | 2/1886 | Ball | 162/250 |
| 428,149 | 5/1890 | Smith | 162/250 |
| 1,579,261 | 10/1925 | Van Alstyne | 162/250 |
| 1,827,658 | 10/1931 | Johnsen | 162/49 |
| 1,837,309 | 12/1931 | Wolf | 162/61 |
| 1,849,866 | 3/1932 | De La Rosa, Sr. | 162/250 |
| 1,911,145 | 5/1933 | Mers | 162/250 |
| 2,141,384 | 12/1938 | Frankel et al. | 162/250 |
| 2,734,378 | 2/1956 | Meyers | 73/63 |
| 2,861,884 | 11/1958 | Bennett | 162/250 |
| 3,306,811 | 2/1967 | Sylvester | 162/123 |
| 3,483,078 | 12/1969 | Sepall et al. | 162/198 |
| 3,540,982 | 11/1970 | Sepall | 162/49 |
| 3,781,188 | 12/1973 | Bagley et al. | 162/49 |

*Primary Examiner*—S. Leon Bashore
*Assistant Examiner*—Steve Alvo
*Attorney, Agent, or Firm*—Stephen P. Gilbert

[57] ABSTRACT

A direct-steamed laboratory minidigester and a method of operating it are disclosed. This unit may be used to predict process parameters, e.g., yield and Kappa number, for operation of commercial direct-steamed digesters. Runs may be made rapidly and with small quantities of wood and chemicals. A plurality of units may be operated in parallel to generate replicate data points for statistical analyses or operated simultaneously, each under different conditions, to screen process variables, e.g., chemical charge, wood furnish, pressure, temperature, steam rate, and cooking time.

5 Claims, 10 Drawing Figures

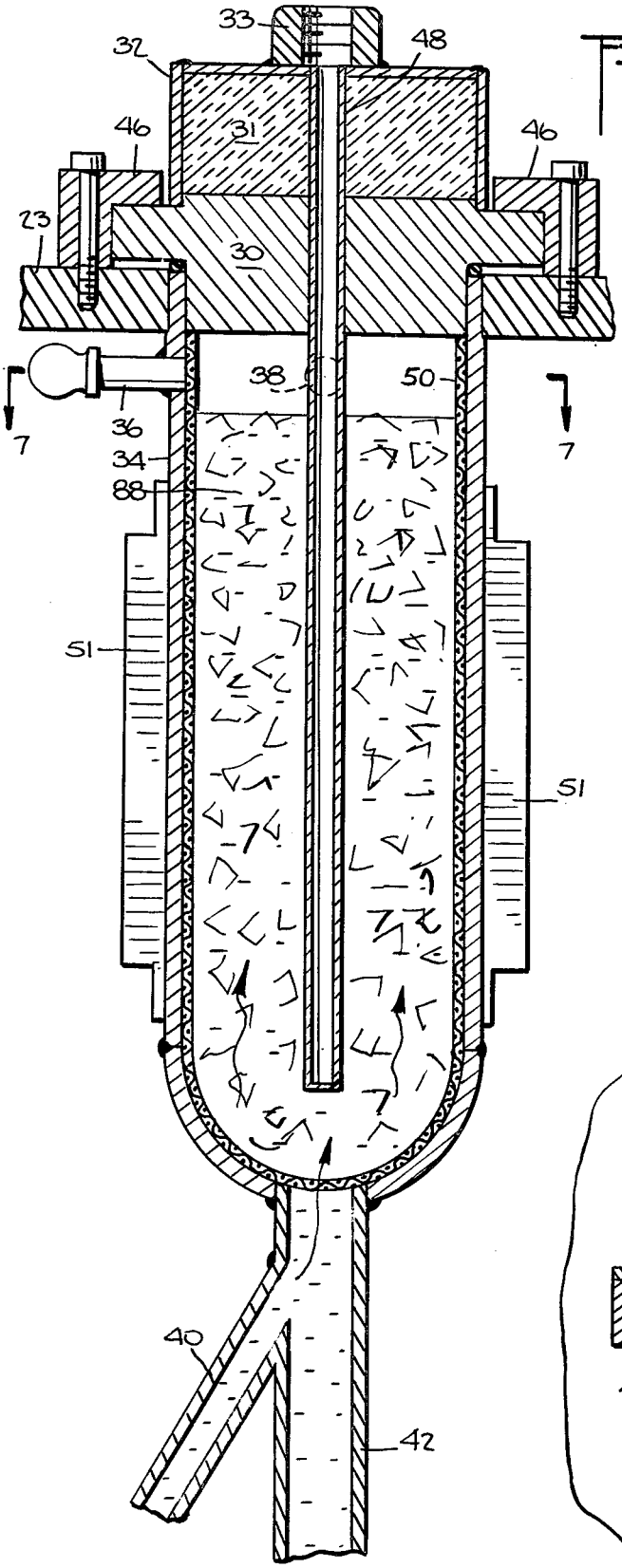
Fig. 5.
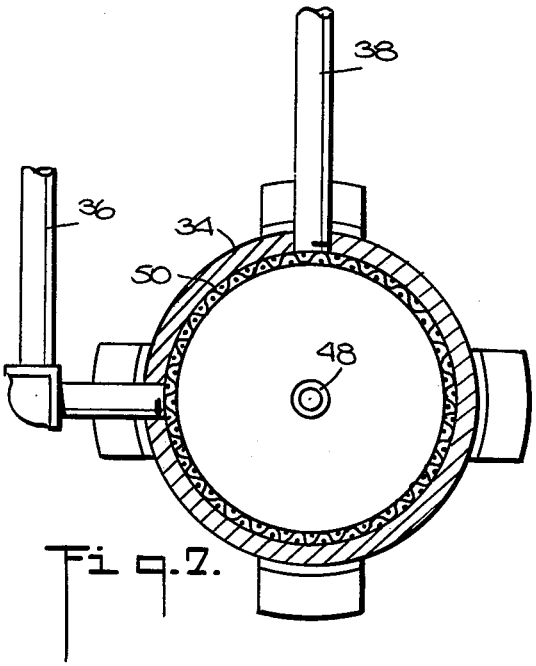
Fig. 7.
Fig. 6.
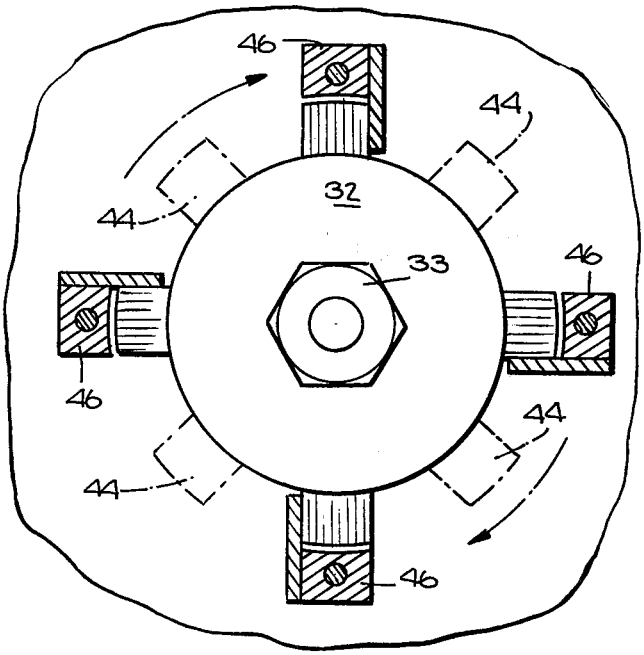

LABORATORY MINIDIGESTERS AND METHOD OF USING THE MINIDIGESTERS

BACKGROUND OF THE INVENTION

This invention relates to a new direct-steamed laboratory minidigester and a method of operating it. The unit may be used to predict the operation of direct-steamed commercial-size digesters.

Commercial digesters in the pulp industry range in size up to 7200 cubic feet or larger. (Digestion is the process of treating wood with chemicals to separate the valuable cellulose from the other constituents of the wood, e.g., lignin). For obvious reasons, it is desirable that the values of various parameters relating to the commercial operation, such as, the required chemical charge and liquor to wood ratio, the yield, and the Kappa number, be known before commencing operation.

Typically, for this purpose, laboratory runs are made with a sample of the wood to be commercially treated. The pilot digesters employed are often from 30 to 50 gallons in capacity and are direct-steamed. Although runs in such equipment are time-consuming and require approximately 40 pounds of wood and relatively large amounts of steam and chemicals, these units are employed because they satisfactorily simulate commercial units.

Much smaller units (holding out fractions of a pound of wood) are also used, but they cannot accurately simulate a commercial direct-steamed digester because they are closed bombs and cannot be direct-steamed. (Direct-steaming provided both heat and agitation.)

In an effort to overcome the lack of agitation in these small units, they are sometimes rocked during operation by shaking devices. However, this also prevents accurate simulation of commercial direct-steamed digesters.

A laboratory digestion unit disclosed in U.S. Pat. No. 3,781,188 comprises several vessels of between 50 and 1,000 cubic centimeter capacity. The vessels are arranged in parallel so that the same digestive liquor may be circulated through each. If operated in this fashion, the same wood must be used in each vessel during a run. Valves are provided to allow isolation of each vessel at different times in the run. These units are not direct-steamed and, thus, do not simulate direct-steamed commercial units. These units may also be run as individual closed bombs, each, if desired, with a different liquor or wood; however, this too fails to simulate direct-steamed commercial operation.

SUMMARY OF THE INVENTION

Broadly, the present invention is a laboratory-size direct-steamed digester and a method for operating it to accurately predict values of parameters for operation of a commercial direct-steamed digester. Attached to the outside of the new minidigester are means for supplying heat to it. Steam is injected through the lower portion of the vessel, and gas can be removed from the upper portion.

A number of these vessels may be arranged in parallel, that is, attached to a common steam supply. Generally, the volume of each vessel is not greater that 25 liters, and, preferably, not greater than 8 liters.

The novel process involves placing wood and the digesting liquid in the vessels, externally heating and adding steam to the vessels, allowing vapors to leave overhead (if desired), and maintaining the temperature of the external heating means at a specified set point. Temperature control of the external heating means on all vessels may be accomplished by monitoring the temperature of just one of the external heating means, assuming the parallel units (vessels, heating means, insulation, etc.) are similar enough.

Although much effort has been expended in trying to provide the paper industry with a small, direct-steamed laboratory digester that accurately predicts process parameters for commercial operation, no such digester has been available until now.

BRIEF DESCRIPTION OF THE DRAWINGS

In order to illustrate one embodiment of the present invention, the following drawings are provided in which:

FIG. 5 is a cut-away view of the minidigester in operation, taken along line 5—5 of FIG. 4;

FIG. 6 is an enlarged top view of the minidigester showing the method of securing the lid to the top of the minidigester;

FIG. 7 is a cut-away top view of the minidigester taken along line 7—7 of FIG. 5;

Figure 1:
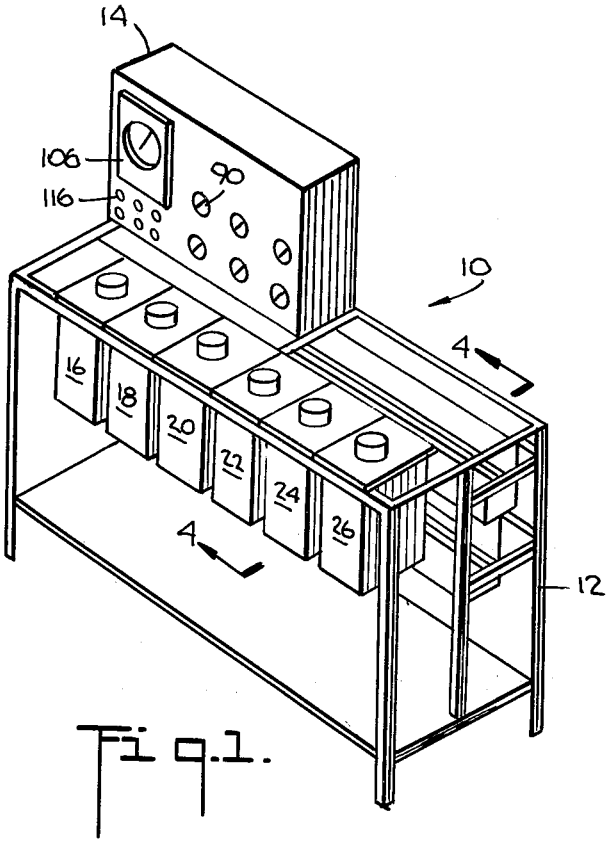
FIG. 1 shows an integrated laboratory unit comprising six of the new minidigesters in protective housings.

It should be understood that these drawings are provided for illustrative purposes only and should not be construed to limit the claims.

DETAILED DESCRIPTION OF THE INVENTION

The overall operation of the new minidigester may be briefly described as follows. The minidigester is preheated by external heating means, and a wood sample and the digestion liquor are placed inside. Steam flow to the bottom of the vessel is commenced, and the vessel is brought up to the desired pressure and temperature and held there for the required "cook" time. During this period, non-condensible gases are vented, and a small amount of steam and volatile organics are condensed. Additionally, the external heating means continues to supply heat during the cook. At the end of the cook, steam flow and heating cease, and the liquor and wood are recovered for analyses.

The volume of the minidigester is generally not greater than 25 liters and, preferably, not greater than 8 liters. The minimum volume is generally 0.5 liters and, preferably, 1 liter. The digester may be of any material that is compatible with the digestion liquids and may be of carbon or stainless steel. Because this is a laboratory unit, stainless steel, usually type 316, is preferred.

The steam line supplying the vessel must be large enough to allow the necessary flow of steam. For multiple vessels in parallel, the steam manifold must be large enough to supply steam to all the units.

One cooling and condensing coil may be used to process the gaseous effluent from one or more vessels. A standard coil cooled by any conventional means, preferably by submerging the coil in cooling water, may be used. The drain line from the condenser must be large enough so as not to plug. The means for supplying heat externally to the vessel can be any type of easily controlled heating means and, preferably, is electrically powered, e.g., a strip heater or heating tape. A steam jacket or a steam coil may also be used. For a 2.5 liter vessel, the total power for the heater(s) on the vessel ranges from 5 to 5000 watts and, preferably, from 200 to 1200 watts.

To control the temperature of the external heating means, at least one temperature sensor is required. The type of sensor employed does not matter as long as it provides a suitable control signal. The temperature sensor may be located on the digester wall or submerged in the reaction mixture (the mass of liquor and wood chips). Preferably, the temperature sensor is located directly on the heating means. It is a feature of this invention that when a plurality of units are employed with all heating means in parallel, only one temperature sensor need be used, assuming the units are similar enough.

After fabricating the vessel and attaching the heating means and temperature-sensing means, the vessel is placed in a larger container (usually a box), and the annular region is filled with insulation. For convenience, a number of these units may be mounted on a rack that also carries the control instrumentation. Such instrumentation typically includes pressure and temperature controllers.

Operating temperature for the new minidigester ranges from ambient to 250° C. or higher and usually from 150° to 180° C. The pressure may range from 0 to 210 psig or higher and, typically, is from 55 to 120 psig.

The size of the wood charge depends on the size of the vessel. For a 2.5 liter vessel, the charge is generally less than 400 grams and preferably from 225 to 300 grams (dry weight basis).

The digestive liquor employed can be acidic, basic, or neutral and contain any of numerous compounds, alone or in combination. "Pulping Processes" by Rydholm and "Pulp and Paper Manufacture," McGraw-Hill, 1950, both hereby incorporated by reference, disclose various digestion processes and the liquors used therein.

The liquor/wood ratio ranges from 1.0/1.0 to 6.0/1.0 and preferably from 2.5/1.0 to 4.5/1.0. These ratios are of the total weight of liquor, including moisture in the wood, to the weight of oven dry (o.d.) wood.

For a 2.5 liter vessel, the gas-off rate, that is, the flow of effluent gases, measured as equivalent condensate, is generally less than 10 cubic centimeters of condensate per minute and, preferably, from 1.5 to 2.5 cubic centimeters per minute.

The temperature of the external heating means usually will not exceed 300° C. and, preferably, will not exceed 210° C. (The method of selecting this temperature will be described below).

The cook can last as long as desired. Generally, it will not exceed 24 hours, usually it will not exceed 5 hours, and, preferably, it will not exceed 1.5 hours.

Any wood species can be used in the digester. If a plurality of digesters are used in parallel, the wood species can vary from unit to unit because the cooking liquors from the various vessels arenot mixed together as in U.S. Pat. No. 3,781,188.

Turning now to the drawings, FIG. 1 shows one embodiment of the present invention, an integrated laboratory unit 10 comprising frame 12, instrumentation box 14, and six 2.5 liter minidigester in protective, insulating housings 16, 18, 20, 22, 24, and 26. Frame 12, constructed primarily of 1 inch by 1 inch and 1 inch by 1.5 inch angle irons, measures approximately 72 inches by 48 inches by 28 inches. Instrumentation box 14 contains cam controller 106, six pressure gauges 90 (only one of which is labeled), and six heater switches 116 (only one of which is labeled).

Figure 2:
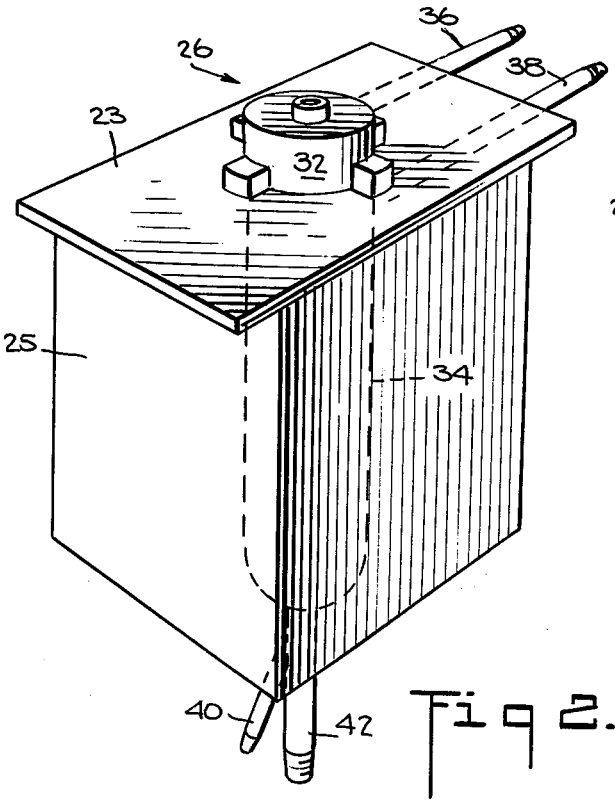
FIG. 2 shows one of the six units of FIG. 1 in its housing.

FIG. 2 shows unit 26 individually. This unit comprises insulated box 25, lid 23, minidigester body 34, and minidigester top 32. Drain pipe 42, steam supply line 40, overhead vapor line 38, and pressure gauge line 36 are connected to the minidigester.

Figure 3:
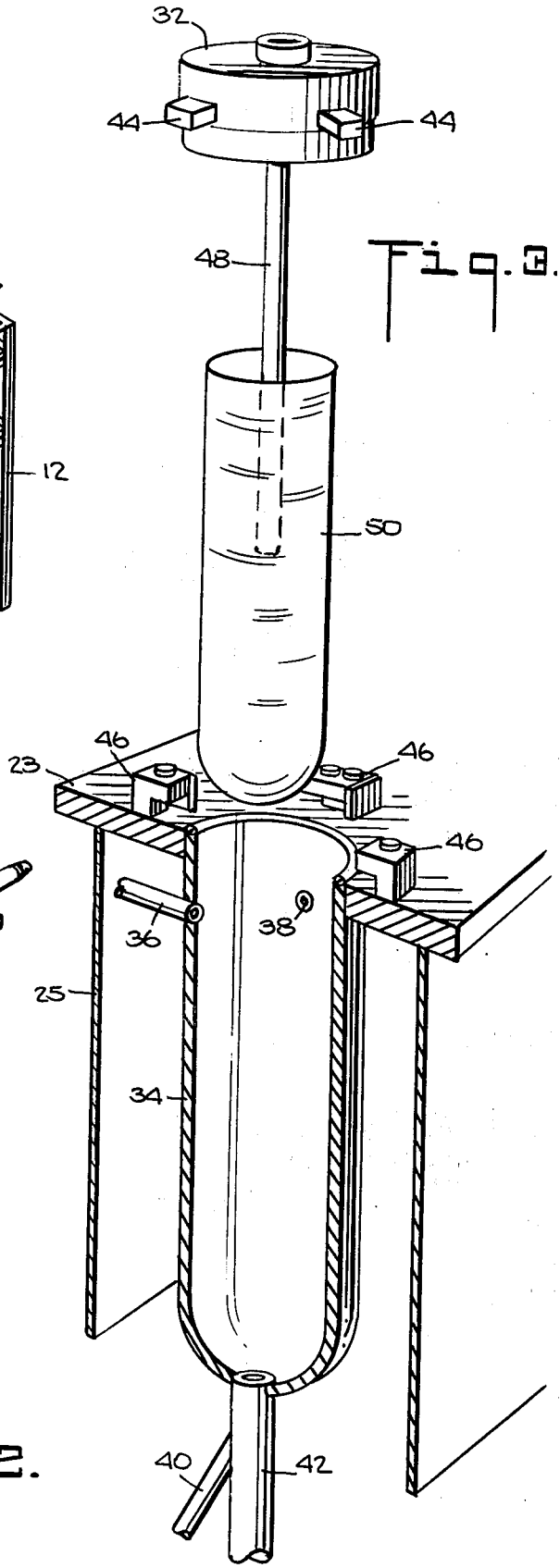
FIG. 3 is an exploded view of the minidigester in its protective housing.

FIG. 3 is an exploded cut-away view showing the minidigester of FIG. 2. Four locking posts 46, only three of which are shown, are attached to box top 23. Corresponding to locking posts 46 are four locking keys 44 on minidigester top 32 (only two of the keys are shown). Connected to vessel lid 32 is thermowell 48, which extends into the reaction mass when the vessel is closed, and can contain a temperature sensor, e.g., a thermometer, thermocouple, or thermistor, to measure the mass temperature. Wire basket 50 holds the wood sample during operation, thus preventing wood particles from pluging any of the lines connected to the vessel, and provides a way of removing the wood particles after the cook is completed. This wire basket may be of any material, but preferably is of the same material as the rest of the minidigester.

Figure 4:
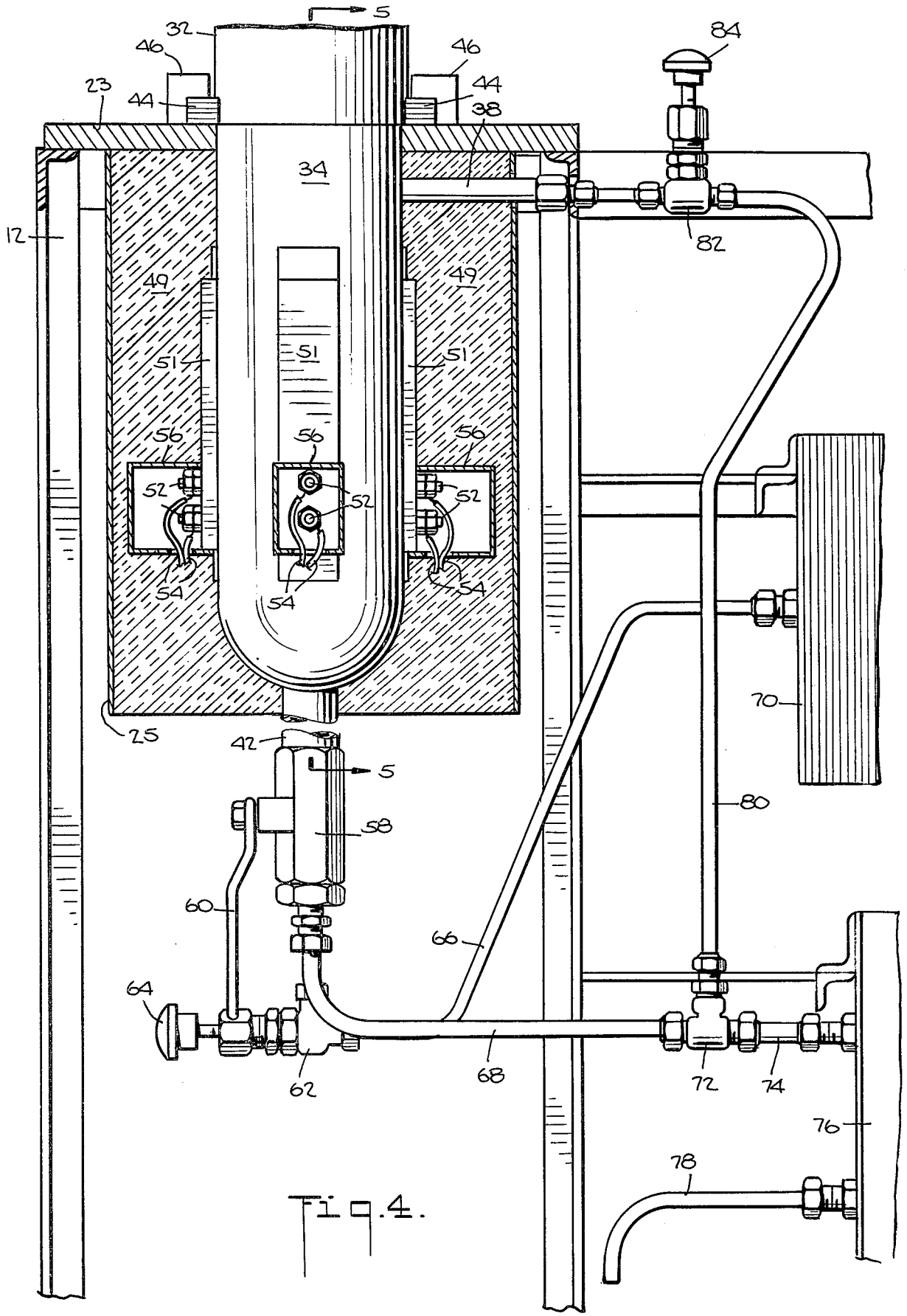
FIG. 4 is a sectional view showing the piping associated with each minidigester, taken along lines 4—4 of FIG. 1.

FIG. 4 is a cut-away view of unit 26, taken along line 4—4 of FIG. 1. Vessel 34 is encased in insulation 49 within box 25. Four strip heaters 51, only three of which are shown, are mounted on the vessel wall. Wires 54 supply power to strip heaters 51 at terminals 52. Boxes 56 protect terminals 52. Each heater 51 can supply 150 watts.

During operation, steam flows from the steam manifold (contained within insulated box 70) through steam line 66 (¼ inch diameter), through regulating valve 62, having handle 64, through check valve 61, into the minidigester along line 40 and a portion of line 42. In FIG. 4, line 40 and check valve 61 are hidden by valve 58; however, line 40 is shown in FIG. 5 and the check valve 61 in FIG. 8. Uncondensed steam and volatile organics and non-condensible gases leave the digester through line 38, pass through valve 82, having handle 84, and then flow through line 80 (¼ inch diamter), through tee 72, into line 74, and into cooling/condensing tank 76. In this tank, vapor is condensed and leaves through condensate line 78 (⅛ inch diameter).

At the end of the digesting run, valve 82 is closed by means of handle 84, and valve 58 is opened by means of handle 60 to allow liquor within the digester to blow down through line 42, into line 68 (⅜ inch diameter), and through tee 72 into line 74 before entering condensing tank 76.

All of the vapor and liquid lines described above are 316 S.S. tubing. Standard tubing connectors, such as, compression fittings, are used to make the connections.

FIG. 5 is a cut-away view of the minidigester in operation. Wood chips 88 are contained within wire basket 50. Thermowell 48 extends down from minidigester top 32 into the reaction mass.

Steam enters the vessel via line 40. Line 36 connects the vapor space of the digester to the respective pressure gauge 90 located in instrument box 14 (FIG. 1).

Minidigester top 32 comprises lid 30, insulation 31, and hex nut 33. The center of hex nut 33 is open to allow entry into thermowell 48.

FIG. 6 is an overhead view of minidigester top 32. To close the vessel, top 32 is placed on box lid 23 (shown in FIGS. 2 and 3) and rotated so as to move each key 44 underneath the hollow portion of the respective locking post 46. For safety, a locking pin (not shown) may be inserted through or next to key 44 and post 46 to prevent accidental couter-rotation and removal of the lid. Use of pliers or a wrench on hex nut 33 facilitates rotation of the minidigester top.

FIG. 7 is a sectional view of the minidigester taken along line 7—7 of FIG. 5. This shows the connections of pressure gauge line 36 and overhead vapor line 38 to digester body 34 and the relative positions of thermowell 48 and wire basket 50 within the vessel.

Figure 8:
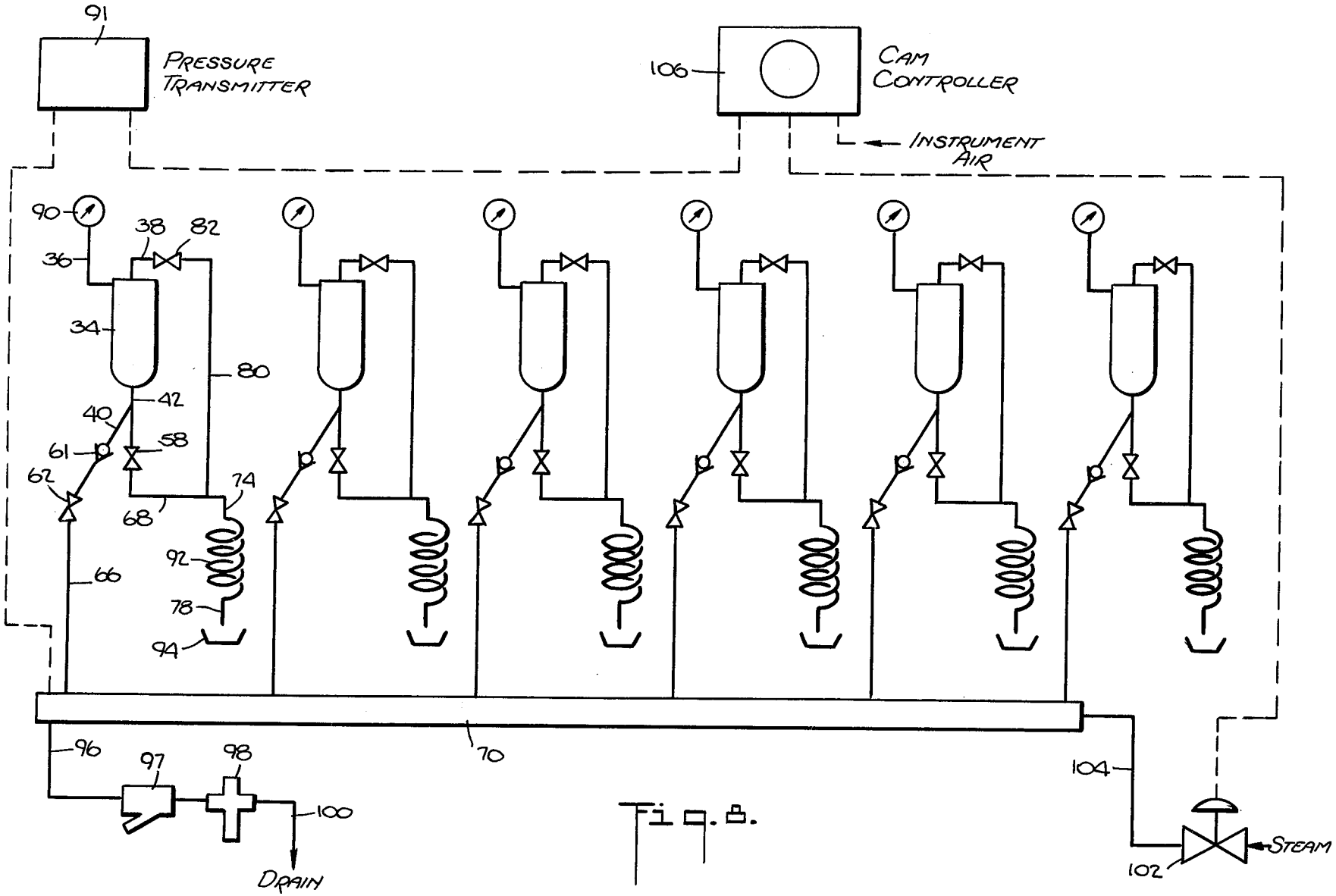
FIG. 8 is a piping schematic of the laboratory unit shown in FIG. 1.

FIG. 8 is a piping schematic of the six-digester unit shown in FIG. 1. For simplicity, reference numerals around only one of the six identical minidigesters are shown.

Steam enters the system through valve 102, passes through line 104, and then into the steam manifold within insulated box 70. Line 66 conveys the steam from the manifold to digester body 34 after passing through needle valve 62, check valve 61, line 40, and a portion of line 42. Condensate from the manifold leaves via line 96, strainer 97, steam trap 98, and drain line 100. Pressure gauge 90 is connected to the digester via line 36.

Vapor effluent from the digester passes through line 38, valve 82, line 80, line 74, and then into condensing tank 76 (shown in FIG. 4). In this tank, coil 92 condenses the vapor and the condensate leaves the tank via line 78 and passes into drain 94.

Pressure transmitter 91 monitors the pressure within the steam manifold and, therefore, within the six minidigesters, in addition to the individual pressure gauges 90 connected to each digester. Cam controller 106 is programmed to control the rate of pressure rise in the digesters, the final cooking pressure, and the duration of the cook.

Figure 9:
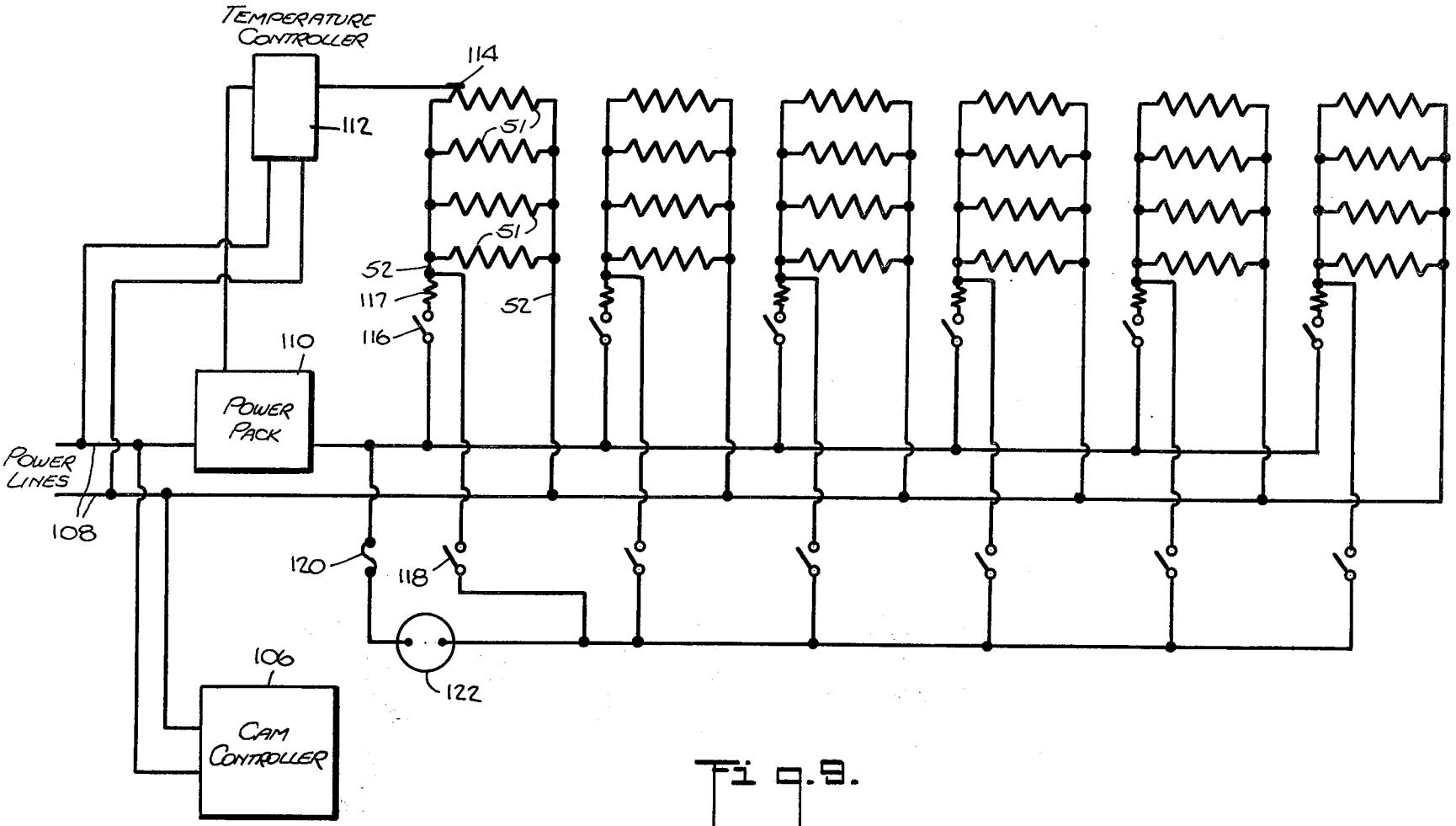
FIG. 9 is an electrical schematic of the laboratory unit of FIG. 1.

FIG. 9 is an electrical schematic of the laboratory unit shown in FIG. 1. Power enters the system via power lines 108. Attached to each digester are four strip heaters, shown as resistance elements 51. These are connected to power lines 108 through switch 116 by supply lines 52. This arrangement is the same for all six units. Temperature sensor 114 lies next to one of the heating elements 51 and sends its signal to temperature controller 112, which, in turn, controls power pack 110. A temperature reading from sensor 114 lower than the set point on controller 112 cause power pack 110 to increase the flow of electrical power to all heating elements on a digester, provided the switch 116 for that digester is closed. (Switch 116 and valve 62 can be used to remove a digester from the system.)

Voltmeter 122 indicates the voltage across resistor 117 (1 ohm) in series with switch 116. This allows calculation of the total current flowing through the heating elements 51 on a particular digester. Rotary switch 118 connects voltmeter 122 to each of the units in turn. Fuse 120 prevents overloading of this circuit.

Cam controller 106 also derives its power from lines 108.

To operate this laboratory unit, power is turned on, the flow of cooling water to condensing tank 76, which contains condensing coil 92, is commenced, and drain valve 58 on each minidigester is closed. The temperature of external heater 51 is brought up to about 95° C. using temperature controller 112 and the digesters are allowed to warm for approximately a half-hour. Next, the cooking liquor and chip samples are put inside each minidigester and tops 32 closed. Gas release valves 82 are then opened from 75 to 125 thousandths of an inch to allow a slow, steady flow of gas to the coolor-condenser. Total condensate at the end of the cook in a 2.5 liter vessel will generally be from 250 to 350 cubic centimeters.

Steam inlet valve 62 on each minidigester is opened, and temperature controller 112 is set to the desired temperature. In accordance with a programmed pressure schedule, the pressure is slowly increased to the desired cook pressure by cam controller 106, which increases the flow of steam through valve 102. At the same time, external heating means 51 supply heat. The combined effect is to slowly raise the temperature and pressure inside the vessel.

For convenience, an arbitrary point is selected as the starting point for a cook. A pressure 1 psi below the nominal cook pressure has been found satisfactory. (It will be understood that the actual cooking may start at a pressure below this arbitrary point, depending on the pressure schedule.) When the cook is over, steam inlet valves 62 and gas-off valves 82 are closed and drain valves 58 are opened, thereby allowing the liquor, now called "spent cooking liquor," to blow out. External heating is halted, and when the pressure drops to atmospheric, vessel tops 32 are removed to retrieve the wood samples. The liquor, wood, and condensate are then analyzed by suitable techniques.

Gases effluent lines 80 need not be manifolded; each can go to a separate condensing coil so that the condensate from each digester may be individually collected and analyzed.

It is important that the temperature of the external heating means be properly chosen and that it be maintained at the desired set point for the following reasons. A heat balance on the minidigester shows that the heat supplied by the external heating means plus the heat supplied by the steam equals the heat needed to bring the reaction mass up to the cook temperature plus the heat lost from the digester to the surroundings.

It has been found that if the steam supplies all the required heat, that is, no external heating means are used, the cooking liquor becomes too diluted by the condensed steam. Conversely, if no steam is used (all the heat is supplied by the external heating means) there will be no agitation, and, thus, will fail to simulate a commercial direct-steamed digester. Thus, the balance between heat supplied by the steam and heat supplied by the external heating means is critical. Since the difference between the temperature of the heating means and the temperature inside the digester is the driving force for the transfer of heat from the heating means to the digester contents, the temperature of the external heating means should be carefully controlled. That is why, preferably, the temperature of the heating means is monitored directly by the temperature sensor.

To determine the proper heating-means temperature for a given cook temperature in a particular minidigester unit, the following equations can be used (the assumptions implicit in these equations will be obvious to one skilled in the art):

$$q = U(T_h - T_l) \quad (1)$$

$$q^* = k(T_l - T_a) \quad (2)$$

$$q - q^* = dH/d\theta - V(dP/d\theta) \quad (3)$$

$$dH/d\theta = M_l C_l (dT_l/d\theta) \quad (4)$$

Assuming that heat imput from heating means plus heat input of steam (from condensation) equals heat loss to environment plus increase in liquor enthalpy, a final equation is obtained:

$$\int U(T_h - T_l)d\theta + M_s \Delta H_v = \int k(T_l - T_a)d\theta + M_l C_l T_l \quad (5)$$

where:

q is the rate of heat transfer to the liquor in the minidigester from the external heating means;

U is the heat transfer coefficient for heat input from the external heating means;

$T_h$ is the heating-means temperature;

$T_l$ is the liquor temperature;

$q^*$ is the rate of heat loss from the liquor to the environment;

k is the heat transfer coefficient for heat loss to the environment;

$q - q^*$ is the net rate of heat transfer to the liquor;

$T_a$ is the ambient temperature;

H is the enthalpy of the liquor;

$\theta$ is time;

V is the minidigester volume;

P is the minidigester pressure;

$M_l$ is the mass of the liquor;

$C_l$ is the heat capacity of the liquor;

$M_s$ is the mass of the steam fed to the digester (assumed to be saturated);

$\Delta H_v$ is the latent heat of vaporization of the steam; and $\Delta T_l$ is the change in liquor temperature.

For an actual apparatus having six 2.5-liter vessels constructed in accordance with the drawings and description herein, steady state valves for U and k were found to be 2.2 and 0.51 watts per Celsius degree, respectively. Equation 5 predicted that with zero steam input and an ambient temperature of 30° C., a heating means temperature of 204° C. would maintain the liquor temperature at 171° C. When the heating means temperature was set to 204° C. and the digesters were filled with wood and liquor, the steady state temperature was found to be 172° C.

For any apparatus embodying the present invention, after U and k are determined (and they will vary from system to system depending on the particular construction used), equation 5 can be used to predict the approximate heating means temperature to maintain a given liquor temperature at a given steam flow, and the exact figure is determined experimentally using the approximation as a starting point.

In the actual apparatus described above, for a Kraft cook liquor temperature of 173° C., a heating means temperature of 193° C. has been found to be suitable when employing a steam flow corresponding to 250 to 350 ml of condensate per minidigester per cook at the presence schedules described below.

The following examples are provided to demonstrate the accuracy and precision of the new apparatus in generating digestion data. These examples should not be construed to limit the scope of the invention.

EXAMPLE I

Figure 10:
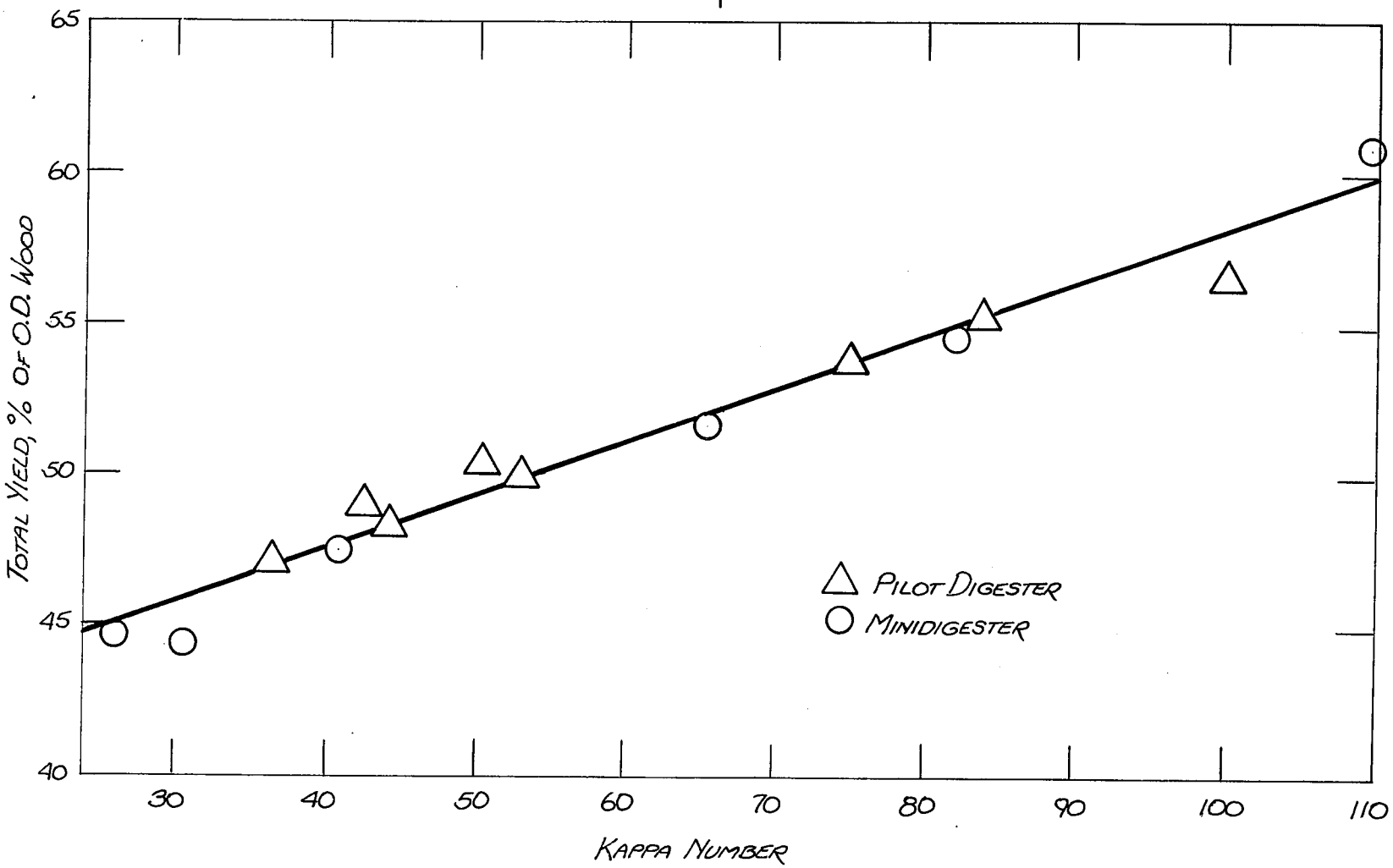
FIG. 10 is a plot of yield versus Kappa number showing data generated by the new laboratory apparatus and by a conventional pilot digester.

Yield-Kappa number data generated by a pilot digester and by the six-unit minidigester apparatus described above were plotted on the same graph (FIG. 10). The pilot unit is a direct-steamed 3.5 cubic foot unit holding from 30 to 40 pounds of wood. It is known that it accurately simulates commercial operation. All of the data shown are for Kraft cooking of southern pine.

Inspection of the graph shows that the apparatus of the present invention satisfactorily simulates operation of the pilot digester and, therefore, of a commercial direct-steamed unit.

EXAMPLE II

Kraft cooks of southern pine were made using the same six-minidigester unit described above, in accordance with the method described above. The maximum temperature of the digesters was approximately 173° C. in all cases. Over twenty sets of cooks were made (a total of 53 cooks), all employing a 4/1 liquor/o.d. wood ratio. The sulfidity of the liquor ranged from 20 to 25% (total alkali basis) and the amount of active alkali (expressed as $Na_2O$ on o.d. wood) varied from 17 to 23%. After steam flow was commenced, 90 minutes were required for the presence to increase to cooking pressure (110 psig). The cooking pressure was then maintained for 60 minutes. (This pressure schedule may be referred to as 90 min.up/60 min.on/110 psig.) The only variations within each set of cooks were the particular digester used or time of use, if operated more than once.

Statistical analysis of the data indicates that the standard deviation in Kappa number is 1.4 Kappa number units, that is, 4.6% of the average Kappa number. The standard deviation in yield is 0.85 percentage points, which is 1.9% of the average yield. These low standard deviations show that the minidigester of this invention can be used with confidence to generate statistically reproducible results.

EXAMPLE III

Additional runs were made using the same apparatus and procedure as in Example II to allow comparison of the yields of two or more treatments at a fixed Kappa number. The temperature of the digesters was approximately 173° C. in all cases. Four sets of Kappa cooks (fifty cooks total) were made on southern pine using a 4/1 liquor/o.d. wood ratio. The amount of active alkali varied from 14 to 28% (expressed as $Na_2O$ on o.d. wood) and the sulfidity was 20 to 25% (total alkali basis). In all cooks either 60 or 90 minutes were required to raise the pressure to cooking pressure (110 psig), which was then maintained for 60 minutes. Within each set of cooks, the same chip batch was used.

Using the fact the yield-Kappa number relationship is linear, the standard deviation in yield for a fixed Kappa number was calculated to be 0.61 percentage points, which is 1.3% of the avarage yield. This low standard deviation again indicates the reproduceability of results when using the method and apparatus of the present invention.

EXAMPLE IV

Five sets of cooks (twenty-two cooks total) in the pilot digester were analyzed to determine the standard deviation in yield and in Kappa number at fixed cooking conditions and in yield at a fixed Kappa number. These are the same three parameters determined for the minidigester in Examples II and III.

Table I below summarizes the cooking conditions for each set of runs. In all runs, a 3/1 liquor/o.d. wood ratio and 110 psig cooking pressure were used.

Table II shows the three standard deviations determined for the pilot unit as well as those Examples II and III for the minidigester unit.

Table I

| | | Liquor | | Cooking Schedule | |
|---|---|---|---|---|---|
| Set | Wood | Sulfidity* | Active Alkali** | Minutes to Pressure | Minutes at Pressure |
| 1 | Mixed Southern Hardwood | 25% | 14% | 60 | 60 |
| 2 | Southern Pine | 25% | 17% | 90 | 60 |
| 3 | Southern Pine | 25% | 17% | 90 | 60 |
| 4 | Southern Pine | 30% | 12–20% | 75 | 45 |
| 5 | Southern Pine | 25–30% | 14–17% | 75 | 45 |
| | | | | 90 | 60 |

*total active alkali
**as $Na_2O$ on o.d. wood

Table II

| | Standard Deviation | | |
|---|---|---|---|
| | Fixed Cooking Conditions | | Fixed Kappa Number |
| Unit | Yield | Kappa No. | Yield |
| Six-Minidigester Unit (Ex. II and III) | 1.9% of avg. yield | 4.6% of avg. Kappa No. | 1.3% of avg. yield |
| Pilot Digester (Ex. IV) | 2.0% of avg. yield | 2.3% of avg. Kappa No. | 1.3% of avg. yield |

Comparison of these values indicates that the pilot digester predicts the Kappa number under fixed cooking conditions somewhat more precisely than does the minidigester; however, the minidigester is more precise in predicting the yield under fixed cooking conditions and just as precise in predicting the yield/Kappa number relationship.

In summary, the minidigester of this invention simulates commercial performance as well as the pilot digester does and with good precision. However, multiple runs can be made in a much shorter period of time in a system having several minidigesters than in one pilot digester and with much less wood and chemicals. This significantly reduces the cost of generating the required data.

Variations in and modifications of the apparatus and method described above will be apparent to those skilled in the art. The claims are intended to cover all such modifications and variations as fall within the true spirit and scope of the invention.

We claim:

1. A laboratory apparatus for generating data regarding the digestion of wood, comprising (A) a plurality of essentially identical direct-steamed laboratory minidigesters, each digester comprising:
  (i) a vessel not greater than 25 liters in volume for containing digestion liquor, said vessel being contained in an insulated enclosure and having a removable top;
  (ii) a basket for containing wood inside the vessel;
  (iii) electrical heating means for supplying heat externally to the vessel; and
  (iv) means for allowing gas and vapor to leave the vessel;

(B) a temperature sensor lying in close proximity to one of the electrical heating means, thereby sensing the temperature of that electrical heating means;

(C) a temperature controller that is connected with the temperature sensor and all of the electrical heating means, wherein the temperature of the electrical heating means is controlled in response to the temperature sensed by the temperature sensor;

(D) a steam manifold for supplying steam internally to each of the vessels so that the steam contacts the digesting liquid; and (E) means for monitoring and for controlling the steam pressure in the steam manifold, which means thereby control the internal pressures of the vessels.

2. The laboratory apparatus of claim 1 wherein no vessel is greater than 8 liters in volume.

3. The laboratory apparatus of claim 1 wherein each vessel is approximately 2.5 liters in volume.

4. A process for operating a laboratory apparatus useful for generating data on wood digestion, said apparatus comprising (A) a plurality of essentially identical direct-steamed laboratory minidigesters, each minidigester vessel being in an insulated enclosure and of 25 liters or less in volume and having (a) a removable top, (b) a basket for containing wood in the vessel, (c) an external electrical heater for supplying heat externally to the vessel, and (d) a valve for removing gas from the upper portion of the vessel; (B) a temperature sensor lying in close proximity to one of the electrical heating means and producing an output signal; and (C) a steam manifold for supplying steam internally to the vessels; said process comprising:

(a) placing wood and digesting liquid in the vessels;

(b) heating the vessels containing the wood and liquid using the electrical heaters;

(c) sensing the temperature of one of the electrical heaters by means of the temperature sensor lying in close proximity to said electrical heater to facilitate control of the temperatures of all of the electrical heaters;

(d) monitoring and controlling the steam pressure in the steam manifold, thereby controlling the pressure in the vessels;

(e) allowing vapors to leave the vessels through the valves; and (f) maintaining the temperatures of all of the electrical heaters at the desired operating temperature through use of the output signal from the temperature sensor.

5. The process of claim 4 wherein step (a) comprises placing wood and digesting liquid in the vessels, each of said vessels being approximately 2.5 liters in volume.

* * * * *

UNITED STATES PATENT AND TRADEMARK OFFICE

CERTIFICATE OF CORRECTION

PATENT NO. : 4,193,840

DATED : March 18, 1980

INVENTOR(S) : Russell S. Andrews, Jr. et al.

It is certified that error appears in the above-identified patent and that said Letters Patent are hereby corrected as shown below:

In col. 1, line 63: "that" should be --than--.

In col. 4, line 1: "arenot" should be --are not--.

In col. 4, line 6: "minidigester" should be --minidigesters--.

In col. 4, line 52: "diamter" should be --diameter--.

In col. 5, line 13: "couter-rotation" should be --counter-rotation--.

In col. 6, line 11: "coolor-condenser" should be --cooler-condenser--.

In col. 7, line 12: "imput" should be --input--.

UNITED STATES PATENT AND TRADEMARK OFFICE

CERTIFICATE OF CORRECTION

PATENT NO. : 4,193,840

DATED : March 18, 1980

INVENTOR(S) : Russell S. Andrews, Jr. et al.

It is certified that error appears in the above-identified patent and that said Letters Patent are hereby corrected as shown below:

In col. 7, line 16: "$M_1C_1T_1$" should be --$M_1C_1\Delta T_1$--.

In col. 7, line 66: "presence" should be --pressure--.

In col. 8, line 28: "presence" should be --pressure--.

In col. 8, line 48: "Kappa" should be --Kraft--.

Signed and Sealed this

*Sixteenth* Day of *September 1980*

[SEAL]

*Attest:*

SIDNEY A. DIAMOND

*Attesting Officer*

*Commissioner of Patents and Trademarks*